US008312990B2

(12) United States Patent
Gaspari et al.

(10) Patent No.: US 8,312,990 B2
(45) Date of Patent: Nov. 20, 2012

(54) ACCESSORY DISPLAY AND STORAGE SYSTEM

(76) Inventors: Seda Gaspari, Los Angeles, CA (US); Mike H. Ananighian, Los Angeles, CA (US)

( * ) Notice: Subject to any disclaimer, the term of this patent is extended or adjusted under 35 U.S.C. 154(b) by 0 days.

(21) Appl. No.: 13/072,066

(22) Filed: Mar. 25, 2011

(65) Prior Publication Data

US 2012/0241329 A1 Sep. 27, 2012

(51) Int. Cl.
*A45C 11/04* (2006.01)

(52) U.S. Cl. ..... 206/6.1; 206/756; 206/566

(58) Field of Classification Search ..... 206/6.1, 206/566, 495, 756; 190/102, 107, 109, 110; 383/38, 39, 40, 119, 117
See application file for complete search history.

(56) References Cited

U.S. PATENT DOCUMENTS

| | | | | | |
|---|---|---|---|---|---|
| 4,735,246 | A * | 4/1988 | Niehaus | 206/6.1 |
| 4,749,604 | A * | 6/1988 | Foster | 428/100 |
| 4,848,562 | A * | 7/1989 | Liu | 206/730 |
| 4,958,727 | A * | 9/1990 | Bergeron | 206/6.1 |
| 5,141,300 | A * | 8/1992 | Ciesla | 312/204 |
| 5,246,103 | A * | 9/1993 | Hicks | 206/6.1 |
| 5,452,806 | A * | 9/1995 | Campas | 211/85.2 |
| 5,671,849 | A * | 9/1997 | Bacon | 211/85.2 |
| 5,779,033 | A * | 7/1998 | Roegner | 206/6.1 |
| 5,890,587 | A * | 4/1999 | Roegner | 206/6.1 |
| 6,371,285 | B1 * | 4/2002 | DuBois | 206/6.1 |
| 6,959,806 | B2 * | 11/2005 | Barker | 206/6.1 |
| 2010/0155266 | A1 * | 6/2010 | Nicholson | 206/6.1 |

* cited by examiner

*Primary Examiner* — Jacob K Ackun
*Assistant Examiner* — Jenine Pagan
(74) *Attorney, Agent, or Firm* — Gene Scott; Patent Law & Venture Group

(57) ABSTRACT

A jewelry and accessory display and storage system includes a foldable base material having arranged pairs of connecting elements spaced at intervals to create a display area with different sections. The connecting elements may be one of snaps, magnets, hook-and-look closures, and ties. Multiple modules, each for holding a particular type of jewelry or accessory, are provided with at least a pair of connecting elements that removably engage with the connecting elements attached to the base material to impart flexibility to the system configuration. The modules may include a necklace module, a bracelet module, a charm or pendant module, a ring module, a clip-on earring module, a stud earring module, a pierced earring module, a cufflink module, a decorative pin or medal module, a watch module, and a pocket module. A method of folding the system for transport is also disclosed.

25 Claims, 8 Drawing Sheets

FIG. 14
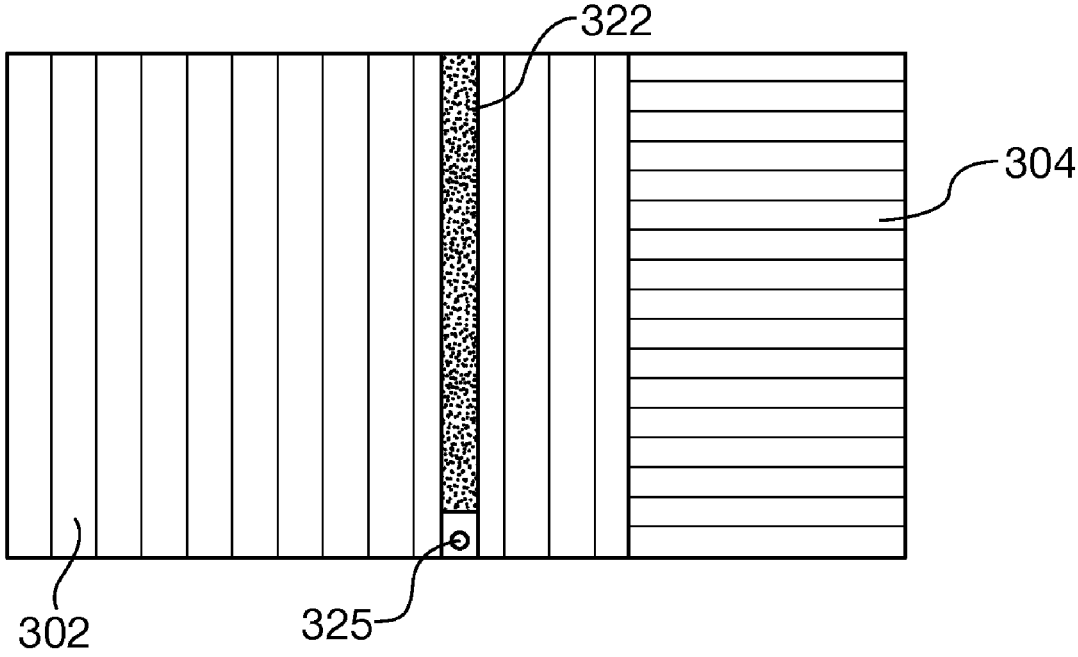
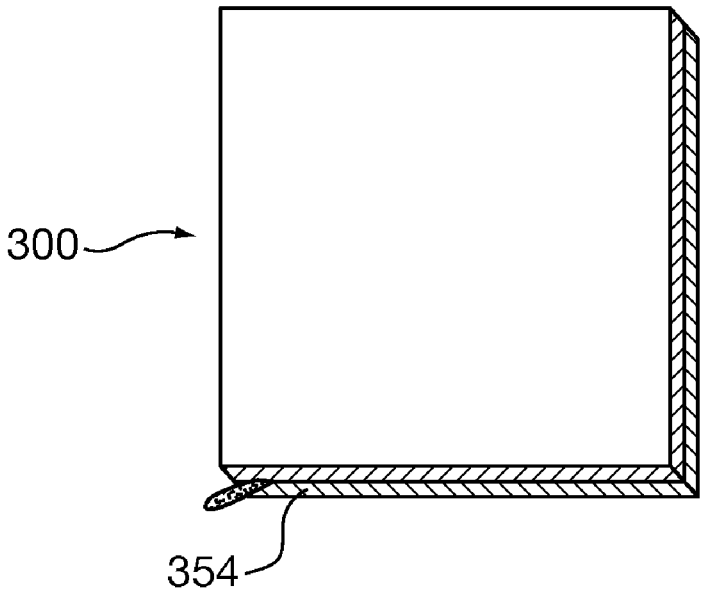
FIG. 15

ACCESSORY DISPLAY AND STORAGE SYSTEM

TECHNICAL FIELD

The present disclosure is directed to the field of jewelry and accessory display and storage. More specifically, the disclosure is directed to a jewelry and accessory display and storage system equipped with multiple removable display modules, which facilitate organization of the accessory items during display and transport.

BACKGROUND OF INVENTION

Many sellers of jewelry and accessories travel from one location to another to participate in jewelry shows, merchandising festivals, and other events. To date, the packing, unpacking, and display of the merchandise has been a time-consuming and tedious process, as multiple items of different types (such as necklaces, bracelets, earrings, and watches) are individually manipulated. Often, the seller resorts to a bulky and cumbersome collection of boxes, jewelry bags, and cases to maintain organization of possibly hundreds of pieces, most of which are concealed from view by their packaging.

Another problem faced by many vendors is that their existing display systems fail to adequately address security concerns. For instance, if the jewelry is displayed in a locked case, customers are unable to closely examine the pieces without vendor assistance. However, if the jewelry is displayed on a table, pieces may be stolen or become easily unorganized, resulting in losses for the vendor or considerable display maintenance.

What is needed in the industry is an accessory system capable of storing multiple types of accessories in an organized manner, which is attractive to potential customers. Further, what is needed is a system with removable modules, so that the vendor may readily assist customers wishing to inspect one or more pieces of a certain accessory type. Also useful would be an accessory system that is configured to be collapsible or foldable, such that the jewelry and accessories could be stored and transported in a compact package without having to be removed from the display.

SUMMARY

The present accessory system addresses at least the above-described needs in the industry.

The present jewelry and accessory display and storage system includes a foldable base material having arranged pairs of connecting elements spaced at intervals to create a display area with different sections. The connecting elements may be one of snaps, magnets, hook-and-loop closures, and ties. Multiple modules, each for holding a particular type of jewelry or accessory, are provided with at least a pair of connecting elements that removably engage with the connecting elements attached to the base material to impart flexibility to the system configuration. The modules may include a necklace module, a bracelet module, a charm or pendant module, a ring module, a clip-on earring module, a stud earring module, a pierced earring module, a leverback earring module, a fishhook earring module, a loop earring module, a cufflink module, a decorative pin or medal module, a watch module, and a pocket module.

A method of folding the system for transport is also disclosed.

BRIEF DESCRIPTION OF DRAWINGS

A full and complete description of the present storage system is provided herein with reference to the appended figures, in which:

FIG. 14 is an overhead plan view of an alternate configuration of the accessory display and storage system of FIG. 1; and FIG. 15 is a perspective view of the alternate accessory display and storage system of FIG. 14, which includes a zipper closure.

DETAILED DESCRIPTION

Reference is now made to the drawings for illustration of an accessory display and storage system. While the display and storage system is shown with a number of different modules for different types of jewelry and accessories, the system may be modified to include fewer types and/or different numbers of modules. In addition, although the loops formed within the modules are shown as being snap closures, other types of closures may instead be used, such as hook-and-loop (Velcro®-type) closures. Similarly, other types of closures may be used to secure the display and storage system in a folded, or closed, configuration, including, but not limited, hook-and-loop closures, zippers, ties, interlocking tabs and slots, and the like. Finally, the display and storage system may be constructed in a variety of sizes and from a variety of flexible materials, including, but not limited to, woven fabrics, jacquard woven fabrics, knit fabrics, non-woven fabrics, leather, artificial leather, vinyl, flexible composites, coated fabrics, and the like. The fabric may be a decorative fabric, such as a jacquard woven fabric in which a design is woven into the fabric.

Figure 1:
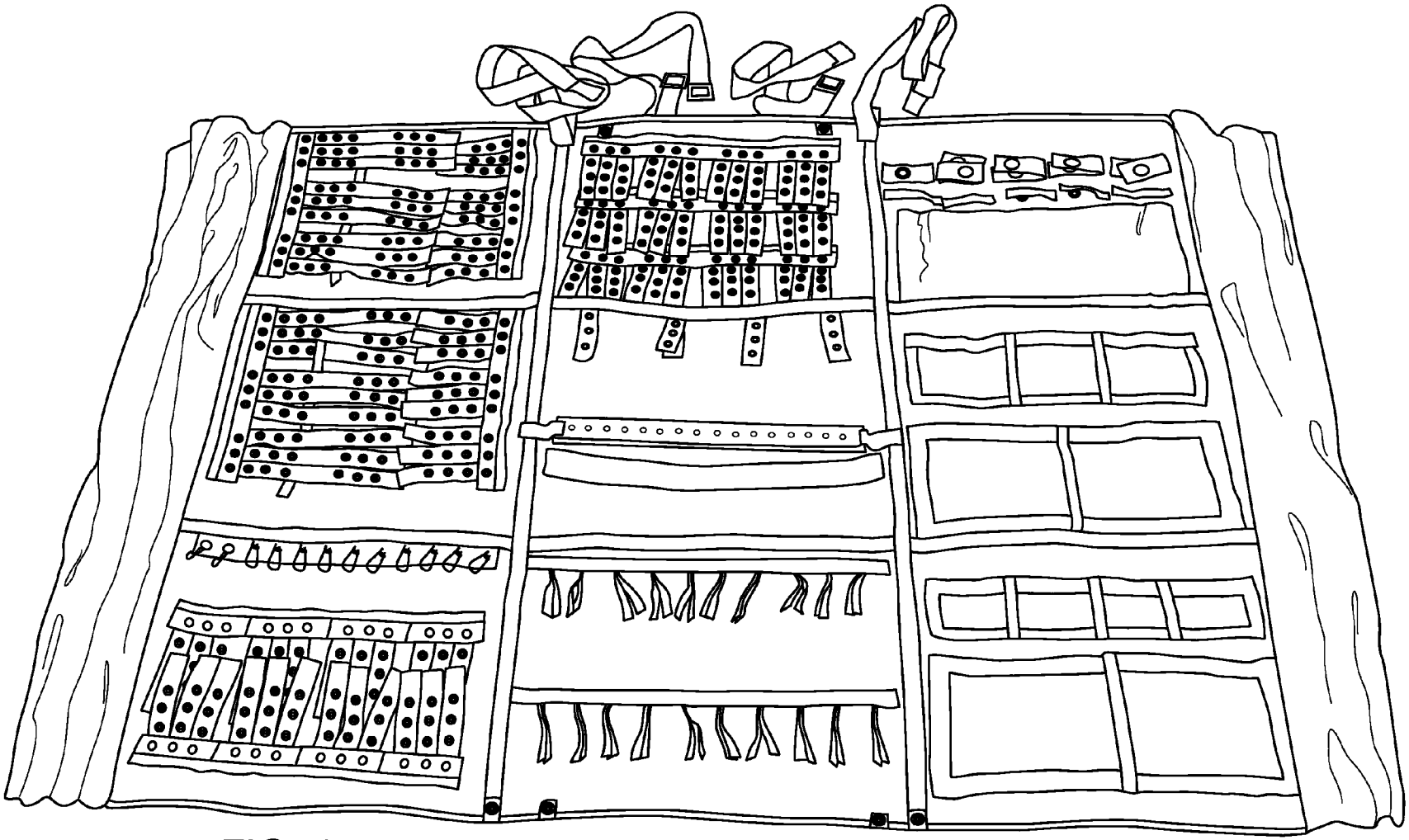
FIG. 1 is an overhead plan view of an accessory display and storage system according to one aspect described herein.

FIG. 1 illustrates a display and storage system 2, according to a first configuration of jewelry and accessory modules 10, 20, 30, etc. The display and storage system 2 includes a base material 4 (such as a woven fabric) with multiple modules 10, 20, 30, etc. that provide separate and distinct areas where different types of jewelry and accessories may be neatly and securely organized. The base material 4 may be a single layer of material. However, the base material 4 may preferably include a cushioned layer (for example, of polyurethane foam or polyester batting) that is sewn between two opposing fabric layers of the same or different construction and/or color. Such a construction cushions the jewelry and accessories and reduces the likelihood of their being damaged during storage and transport. A benefit of this system 2, when opened, is that the jewelry and accessories are easily viewed by passers-by, who may be more motivated or interested in stopping to look at the individual pieces because the display system 2 is attractively arranged.

The base material 4 and the modules 10, 20, 30, etc. include connecting elements that allow the modules 10, 20, 30, etc. to be removed from the base material 4. Throughout the disclosure, the connecting elements may be illustrated and referred to as snaps. However, it should be understood that other types of connecting elements may be used instead of snaps, including, but not limited to, hook-and-loop closures, magnets, ties, clips and rings, and the like.

Figure 2:
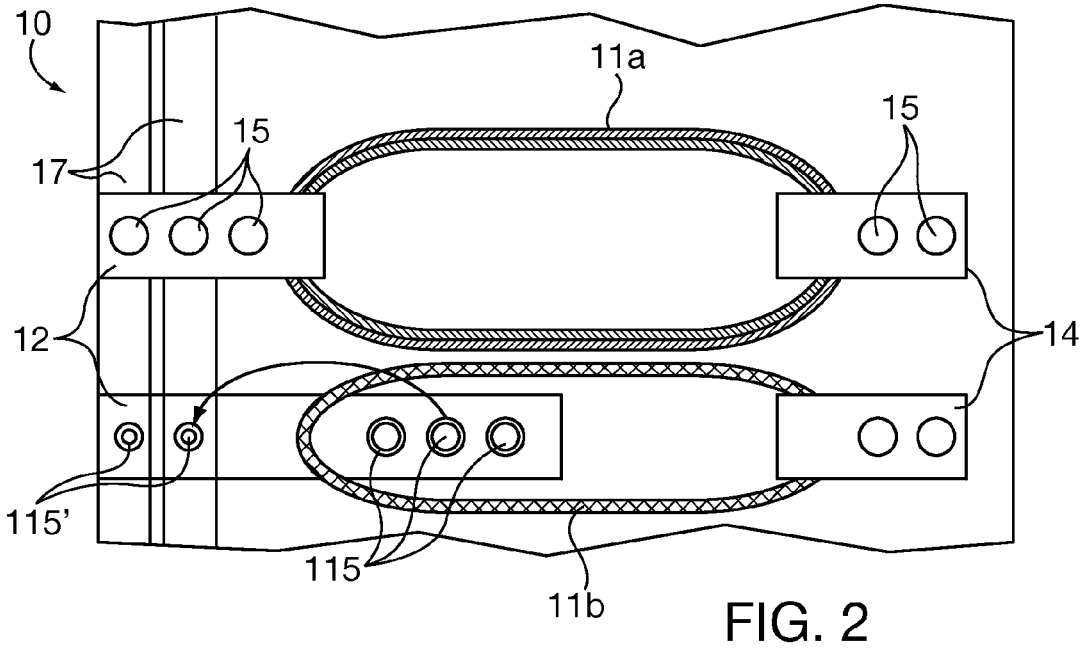
FIG. 2 is an overhead plan view of a necklace module adapted for use in the accessory display and storage system of FIG. 1.

A first module 10 for necklaces is illustrated in FIG. 2. The necklace module 10 includes spaced apart pairs of loops 12, 14, each of which has an attached end, a free end, and one or more connection elements (such as snaps 15) that join the free end to the attached end to form a closed loop. Each pair of loops 12, 14 is preferably aligned longitudinally along a common axis, although the loops 12, 14 may be slightly offset from one another if desired. A first necklace 11*a* is secured between one set of the closed loops 12 and 14. A longer necklace may be positioned between other sets of snaps 15. A second necklace 11*b* is positioned within a closed loop 14 and is shown ready to be secured within loop 12. The free end of the loop 12 is provided with the female parts 115 of the snaps 15, while the male parts 115' of the snaps 15 are secured to the attached end of the loop 12 and to optional reinforcement panels 17. The closure, which is indicated by an arrow, secures the necklace 11*b* within the necklace module 10 for display and storage. Further, the necklace module 10 is adjustable depending on the length of the necklace, as any of the female parts 115 of the snaps 15 can connect with the male parts 115' of the snaps 15.

Figure 3:
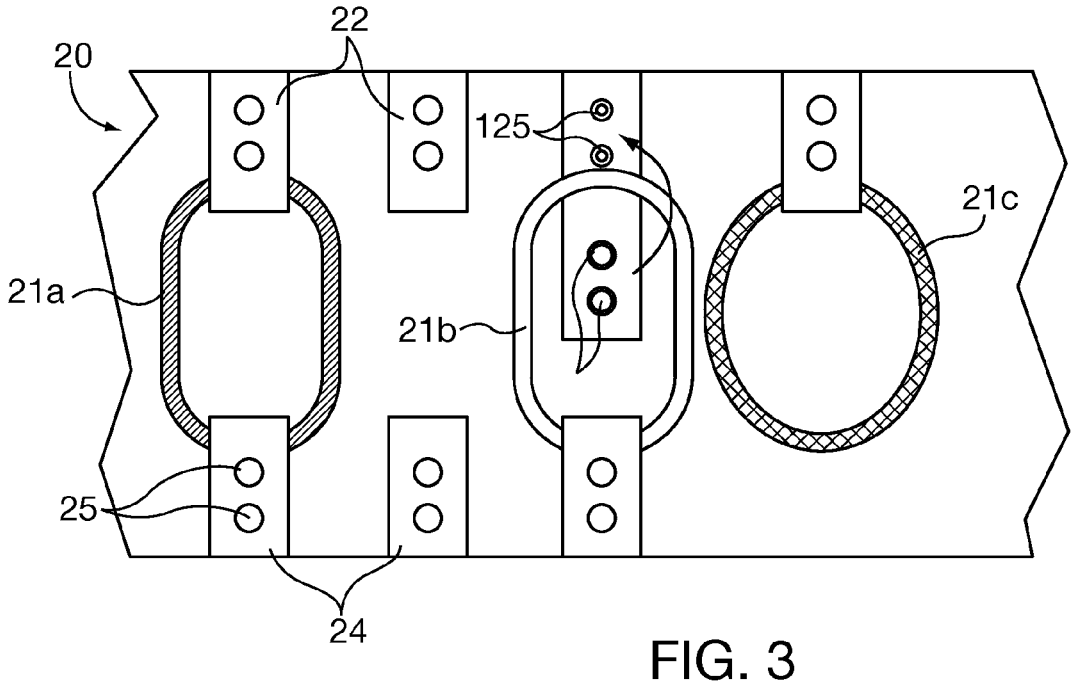
FIG. 3 is an overhead plan view of a bracelet module and bangle module adapted for use in the accessory display and storage system of FIG. 1.

A bracelet module 20, which is shown in FIG. 3, operates using similar loops 22, 24, the length of each corresponding pair being aligned along the same central axis. A first bracelet 21*a*, such as a chain bracelet, is positioned between a first loop 22 and an opposing second loop 24, each of which is provided with an attached end, a free end, and one or more connection elements (such as snaps 25) that join the free end to the attached end to form a closed loop. A second bracelet 21*b* is positioned within a closed loop 24 and is shown ready to be secured within an open loop 22. The female parts 125 of the snap 25 on the free end of the loop 22 are positioned over and snapped onto the male parts 125' of the snaps 25 on the attached end of the loop 22, thus holding the bracelet 21*b* within the module 20. Further, the bracelet module 20 is adjustable depending on the length of the bracelet, as any of the female parts 125 of the snaps 25 can connect with the male parts 125' of the snaps 25.

Alternately, for a bangle-type bracelet with a rigid structure, the second loop 24 may be unnecessary, as the bracelet 21*c* may be held within a single loop 22, either between the snaps 25 (as shown) or between the snap 25 and the interior portion of the loop (as shown with regard to the bracelet 21*a*).

The display and storage system 2 may be provided with two separate modules, one for chain bracelets (e.g., 21*a*), which uses opposing loops 22, 24, and one for bangle bracelets (e.g., 21*c*), which has a single loop 22 for each bracelet. Alternately, bangle bracelets may be stored in the same module 20 as the chain bracelets, using only those loops as are needed to secure them.

Both the necklace module 10 and the bracelet module 20 may include loops 12, 14, 22, 24, respectively, that are sewn directly to the underlying base material 4. Instead of sewing the loops to the base material 4, however, the loops may be sewn to a separate sheet of material (not shown), which may be secured, in turn, to the base material 4 by snaps or other closure means (see, for example, the separate panel of FIG. 10). In this latter case, the entire module (e.g., 10) may be removed from the accessory display and storage system 2 without removing the individual necklaces 11*a*, 11*b*, etc.

Figure 4:
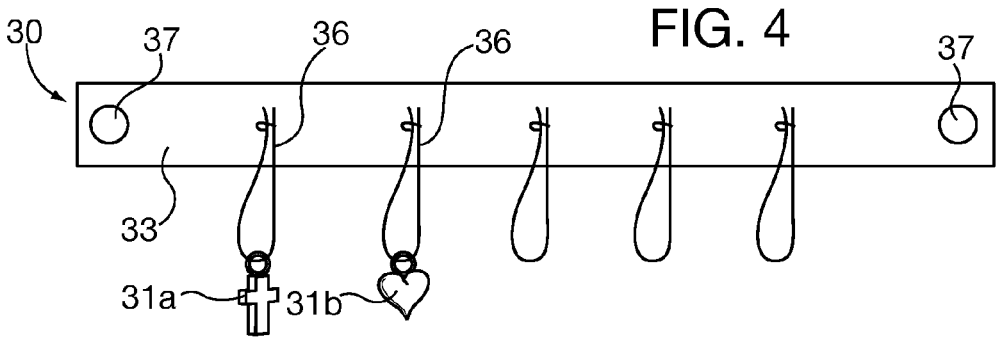
FIG. 4 is an overhead plan view of a charm or pendant module adapted for use in the accessory display and storage system of FIG. 1.

FIG. 4 illustrates a charm or pendant module 30 for the storage and display of bracelet charms and/or necklace pendants 31*a*, 31*b*. The module 30 includes a fabric panel 33 having snaps 37, or other connecting elements, attached at opposite ends thereof. The corresponding opposite sides of the snaps 37 (for example, the male ends) are attached to the base material 4 (not shown in this drawing). The module 30 is provided with a number of fish hook-type hangers 36, onto which the charms or pendants 31*a*, 31*b*, etc. may be hung for display.

Figure 5:
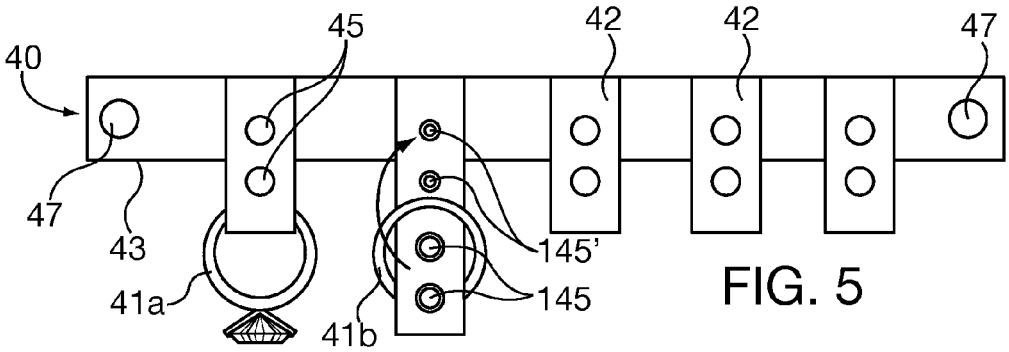
FIG. 5 is an overhead plan view of a ring module adapted for use in the accessory display and storage system of FIG. 1.

A ring module 40 is shown in FIG. 5. The ring module 40 uses a fabric panel 43 to which a number of loops 42 are attached. The loops 42 include an attached end, a free end, and one or more connecting elements, such as the snaps 45, which, when connected, create at least one channel for securing a ring (e.g., 41*a*). The free end of the loop 42 may be positioned within the interior of a ring (e.g., 41*b*), after which the loop 42 is folded along its mid-section (as indicated by an arrow), so that the female parts 145 of the snaps 45 are joined with the male parts 145' of the snaps 45. If desired, two rings may be housed within a single loop 42. The ring module 40 is secured to the base material 4 by snaps 47 or other connecting elements located at the opposite ends of the fabric panel 43.

Figure 6:
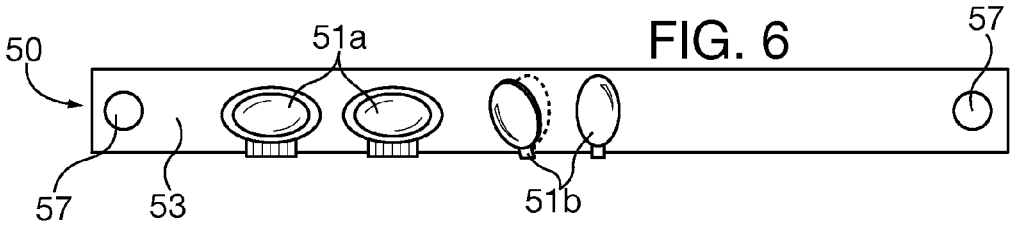
FIG. 6 is an overhead plan view of a clip-on earring module adapted for use in the accessory display and storage system of FIG. 1.

Clip-on earrings 51*a*, 51*b* may be displayed using clip-on earring module 50, as shown in FIG. 6. The clip-on earring module 50 includes a fabric panel 53 having connecting elements, such as snaps 57, located at opposite ends thereof. The clip-on earring module 50 is removably attached to the base material 4, which includes the opposite parts of the snaps 57. To display clip-on earrings on the module 50, each earring (e.g., 51*b*) is opened and is positioned over the fabric panel 53. The earring 51*b* is then closed around the fabric panel 53 to secure the earring 51*b* in position. The number of earrings 51*a*, 51*b* that may be displayed on the module 50 is a function of the length of the fabric panel 53 and the width of the earrings 51*a*, 51*b*.

Figure 7A:
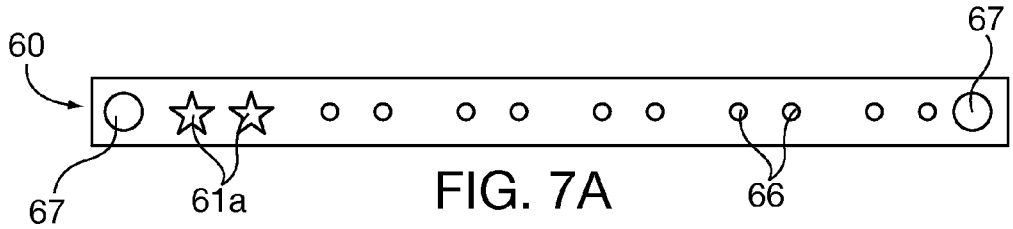
FIGS. 7A and 7B are an overhead plan view and a perspective view of a stud earring module adapted for use in the accessory display and storage system of FIG. 1.
Figure 7B:
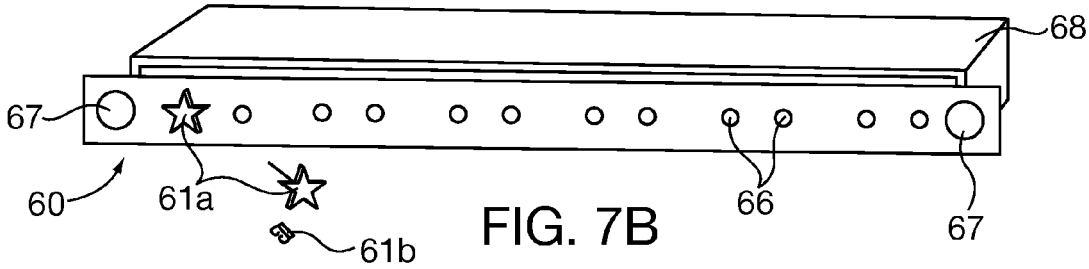

FIGS. 7A and 7B show a module 60 suitable for stud earrings 61*a*. Stud earrings 61*a* are characterized as having a decorative surface (such as the star shape shown in the Figures) and a straight post. An earring back 61*b*, such as a molded plastic element or a curved metal element, secures the earring 61*a* in a desired position, either within the display module 60 or a wearer's ear. The fabric panel 63 includes a number of spaced pairs of holes 66, through which the earring posts may be positioned (as shown in FIG. 7B) and a pair of connecting elements, such as snaps 67, at opposite ends for attachment to the base material 4.

The module 60 also includes a pivoting trough 68 that receives the earring posts and backings. The trough 68 is attached to the base material 4 of the display and storage system 2, such that the trough 68 pivots from an upright position with the trough mouth being parallel to the base material 4 to a substantially horizontal position with the trough mouth nearing the surface of the base material 4. This assemblage prevents the posts from being stored in a position perpendicular to the base material 4, thus reducing the likelihood of the posts being bent during storage and transport.

Figure 8:
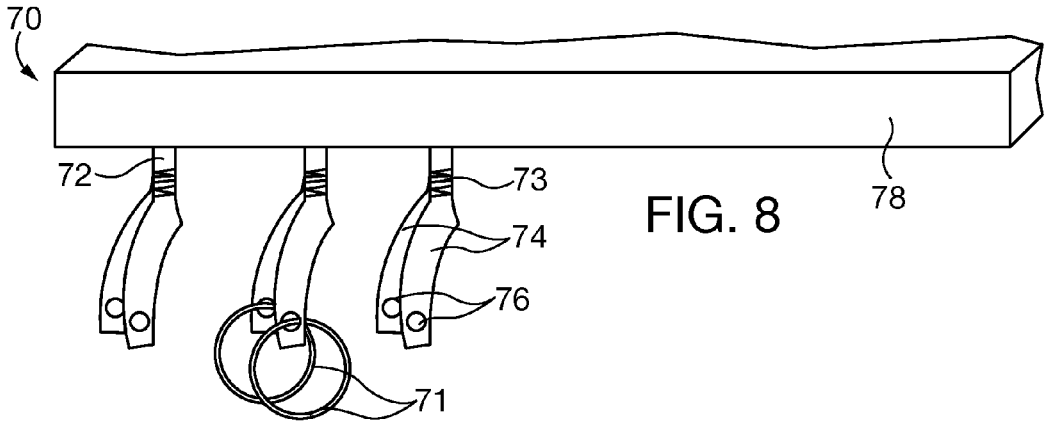
FIG. 8 is an overhead plan view of a pierced, leverback, fishhook and loop earring module adapted for use in the accessory display and storage system of FIG. 1.
Figure 9:
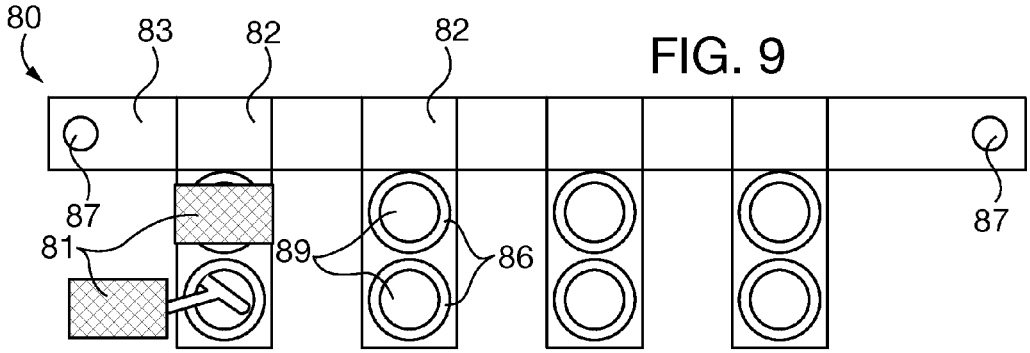
FIG. 9 is an overhead plan view of a cufflink module adapted for use in the accessory display and storage system of FIG. 1.

FIG. 8 illustrates yet another earring module, which is useful for pierced earrings 71 having other types of backings. A pierced earring module 70 is formed of a rectangular prism-shaped support 78, provided with snaps or other connecting elements (not shown) at opposite ends thereof for attachment of the module 70 to the base material 4. A number of stems 72 extend from the support 78 and a pair of leaves 74 extends from each of the stems 72. The leaves 74 may be attached to the stem 72 by a crimp 73 or some other attachment means (such as cording wrapping around the leaves 74 and the stem 72). At their distal ends, the leaves 74 are configured with at least one aperture 76 therethrough for receipt of the earring 71. The earring module 70 is useful for larger earrings and earrings having backing elements other than straight posts, such as leverback, fishhook and loop earrings. As with the stud earrings, the backings of the pierced earrings 71 in the module 70 are stored at an angle that is non-perpendicular to the plane of the base material 4, to prevent bending.

Cufflinks 81 may also be displayed and stored within the accessory display and storage system 2. A cufflink module 80 includes a fabric panel 83 to which a number of tabs 82 are attached. Each tab 82 includes at least two apertures 89 that are fitted with grommets 86 for receipt of a pair of cufflinks 81. The opposite ends of the fabric panel 83 are provided with connecting elements, such as snaps 87, for attachment to corresponding connecting elements on the base material 4.

Figure 10:
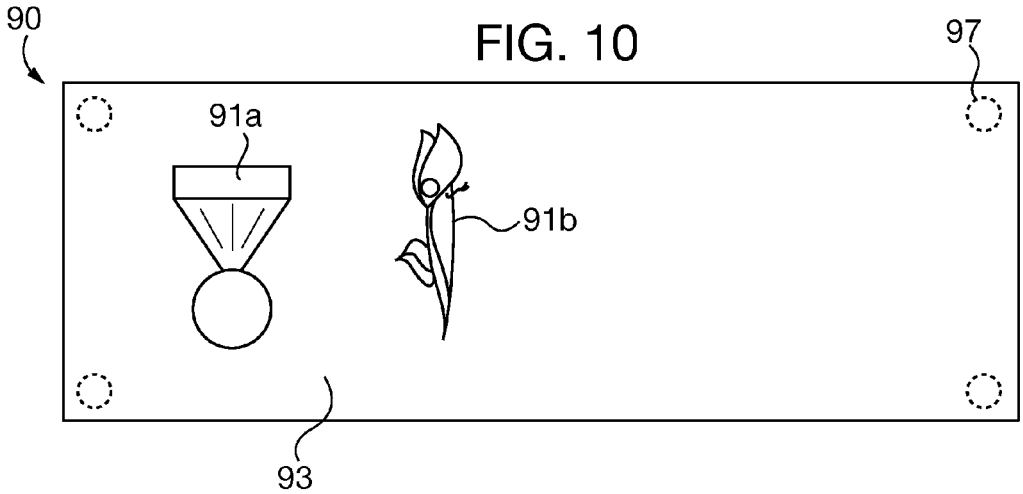
FIG. 10 is an overhead plan view of a decorative pin module adapted for use in the accessory display and storage system of FIG. 1.

FIG. 10 illustrates a decorative pin module 90 that includes a fabric panel 93 having connecting elements, such as snaps 97, attached to the back at the corners thereof. The fabric panel 93 may be made of velvet or another plush fabric, which provides cushioning to the pins 91*a*, 91*b* and which better masks the holes resulting from having pins 91*a*, 91*b* inserted and removed. The module 90 may be used for decorative pins, such as flower pin 91*b*, or medals 91*a* or similar other awards. As with the other modules, connecting components are attached to the base material 4 for joining with the connecting elements 97 on the pin module 90.

Figure 11:
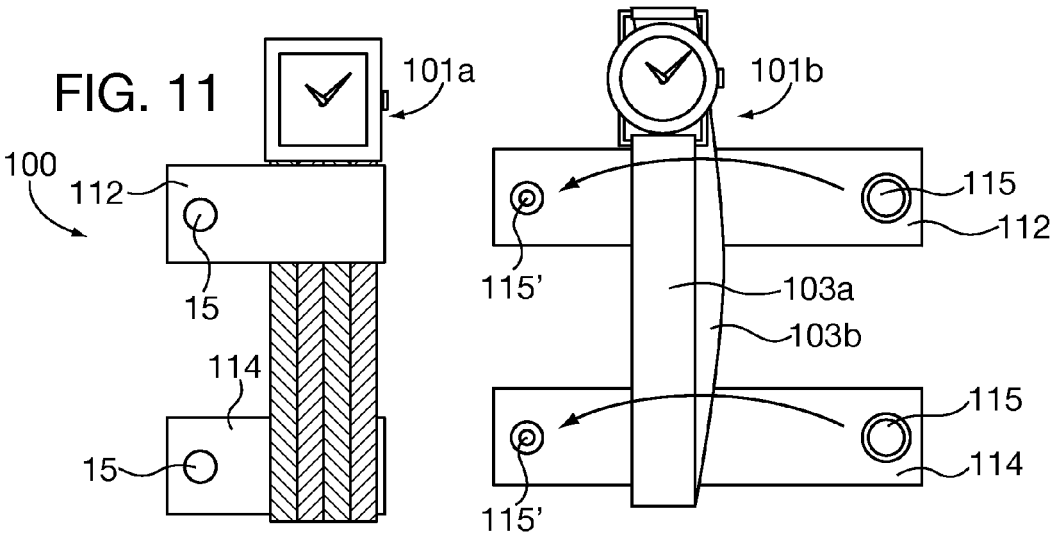
FIG. 11 is an overhead plan view of a watch module adapted for use in the accessory display and storage system of FIG. 1.

A watch module 100 is shown in FIG. 11. Each watch 101*a*, 101*b*, etc. is secured between two loops 112, 114. The loops 112, 114 are sewn, or otherwise attached, to the base material 4 (not shown) with their longitudinal axes in parallel to one another. The loops 112, 114 each have an attached end, a free end, and at least one connecting element attached to the ends thereof.

The upper loop 112 is located in a position near the face of the watch 101*a* and may have a greater width than the lower loop 114. As seen in the right portion of FIG. 11, a watch 101*b* is positioned over the extended, open loops 112, 114. The upper loop 112 is extended over both sides 103*a*, 103*b* of the watch band and secured by joining the female part 115 of the snap 15 and the male part 115' of the snap 15. The lower loop 114 is positioned between the sides 103*a*, 103*b* of the watch band and is joined by the snap 15 on the lower loop 114.

Figure 12A:
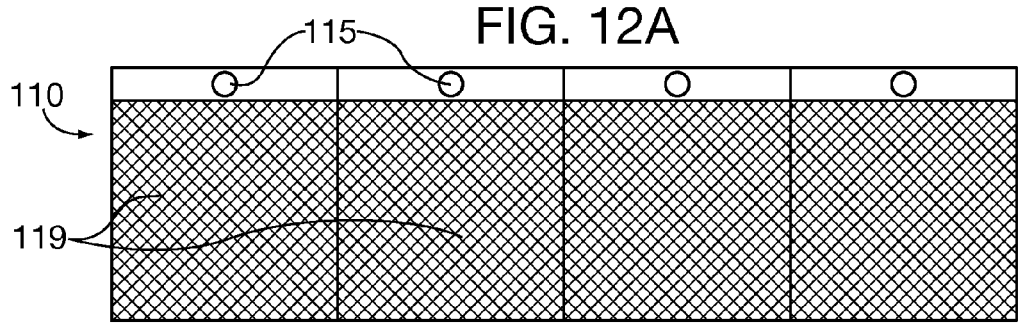
FIGS. 12A through 12 C are overhead plan views of pocket modules for use in the accessory display and storage system of FIG. 1.
Figure 12B:
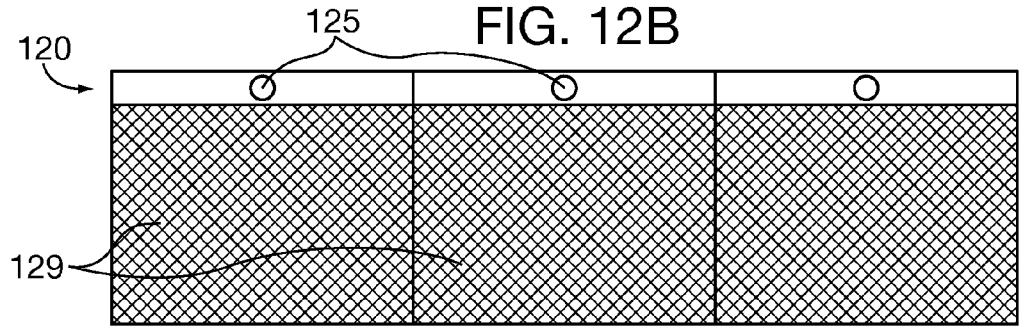
Figure 12C:
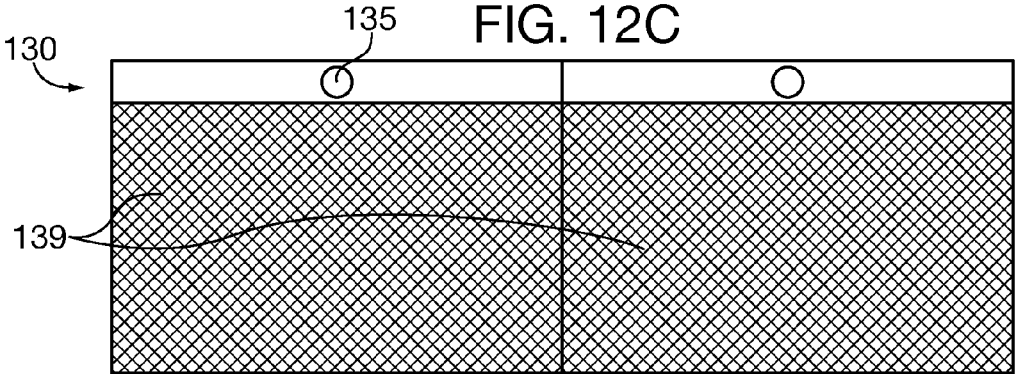

As shown in FIGS. 12A through 12C, the accessory display and storage system 2 may further be provided with modules 110, 120, 130 having any number of pockets 119, 129, 139, respectively. The pockets 119, 129, 139 may be constructed of a mesh material, a translucent or sheer material, or a transparent material (such as clear vinyl) that is sewn onto the base material (4). Alternately, the pockets 119, 129, 139 may be sewn onto a separate fabric panel, which may be joined to the base material (4) by connecting elements (such as with module 90 in FIG. 10). The pockets 119, 129, 139 may include a front side and a back side, or may include only a front side, in those cases where the base material (4) forms the back of the pockets 119, 129, 139. Each pocket 119, 129, 139 may be closed by a snap closure 115, 125, 135, or other joining devices, such as a hook-and-loop closure, a magnet closure, or a zipper.

FIGS. 13A through 13J illustrate a representative method of preparing the display and accessory system 2 for storage and transport. In a fully open configuration, the display area 204 may be segmented into three sections 204*a*, 204*b*, 204*c*. At the upper side of each section 204*a*, 204*b*, 204*c*, a reinforcing strap 222*a*, 222*b*, 222*c*, respectively, is located for attachment to snaps 225. For simplicity, the individual modules are not shown in their positions in the display area 204.

A protective cover 202 extends outwardly from a first section 204*a*, while a similar protective cover 206 shares a common side with another section 204*c*. The size of the protective covers 202, 206 may be greater than half the width of the display area 204, so that the covers 202, 206 overlap one another when the display and storage system 2 is closed. The outboard corners of the covers 202, 206 are provided with connecting elements (such as snaps) for joining the covers 202, 206 to corresponding connecting elements 227, 223, respectively, which are located along the lower edge of the center display section 204*b*.

The protective covers 202, 206 may be constructed from the same material as the base material 4, although it may be desirable to use a lighter weight material for ease of folding. The material for the protective covers 202, 206 may be the same color as that of the base material 4, or may be a complementary or coordinating color to enhance the appearance of the display and storage system 2. When the display and storage system 2 is in use, the protective covers 202, 206 and the reinforcing straps 222*a-c* may be simply folded beneath the display area 204.

Figure 13A:
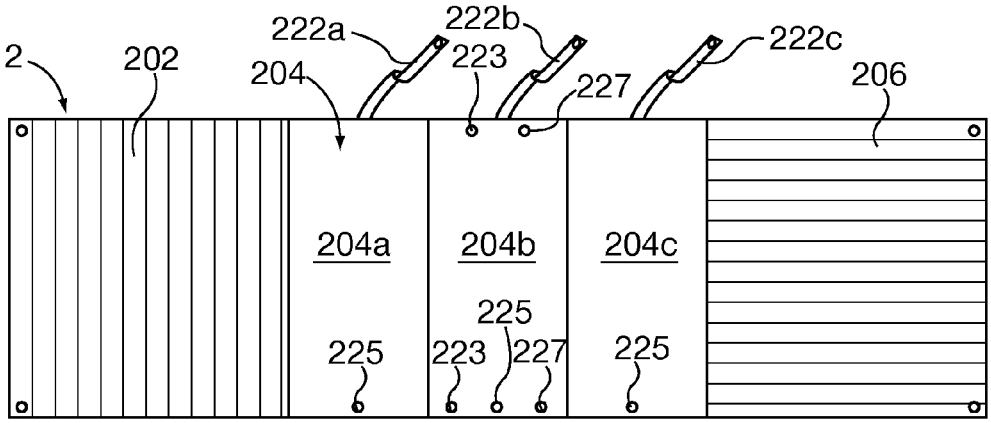
FIGS. 13A through 13J are overhead plan views and perspective views of the accessory display and storage system and a method of folding the accessory display and storage system to a compact size.
Figure 13B:
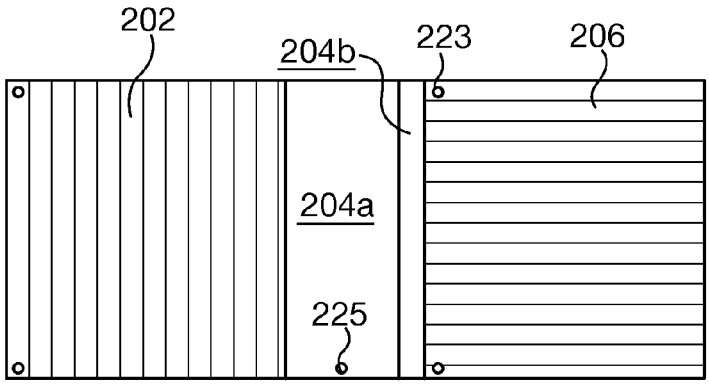

As shown in FIG. 13B, the protective cover 206 is positioned over the display section 204*c* and a portion of the display section 204*b*. The cover 206 is attached by joining the snaps 223 or other connecting elements.

Figure 13C:
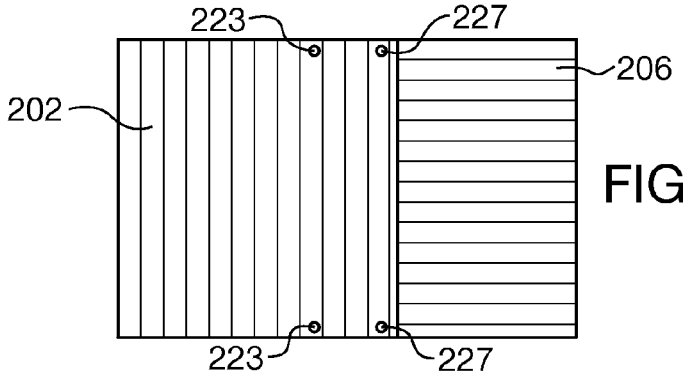

FIG. 13C illustrates the positioning of the protective cover 202 over the display section 204*c*, a portion of the display section 204*b*, and a portion of the protective cover 206. Again, the cover 202 is attached by snaps 227 or other connecting elements.

Figure 13D:
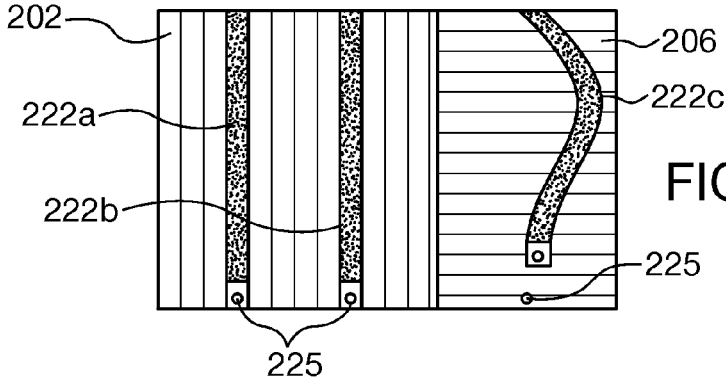

Once the protective covers 202, 206 are secured, the reinforcing straps 222*a*, 222*b*, and 222*c* may be secured using the connecting elements 225, as seen in FIG. 13D.

It should be noted that the locations of the protective covers 202, 206 and the reinforcing straps 222*a-c* may be reversed, with the protective covers 202, 206 extending from the top of the display area 204 and the reinforcing straps 222*a-c* extending from one side (e.g., 204*a*) of the display area 204 to the opposite side (e.g., 204*c*). Alternately, both the protective covers 202, 206 and the reinforcing straps 222*a-c* may be secured to the top side of the display area 204 and extend downwardly over the display area 204.

Additionally, while the protective covers 202, 206 are shown as having a width greater than half the width of the display area 204, it is possible to use protective covers 202, 206 having half, or approximately half, the width of the display area 204. With these configurations, other methods for securing the protective covers 202, 206 may be used, including, but not limited to, ties, a zipper, hook-and-loop closures, magnets, and the like.

Figure 13E:
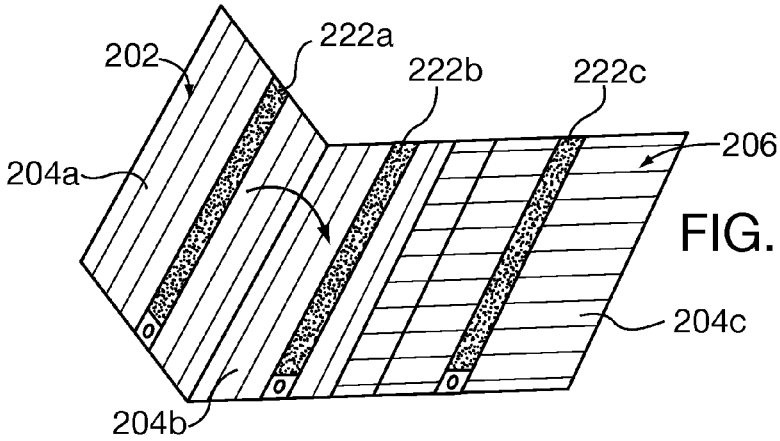
Figure 13F:
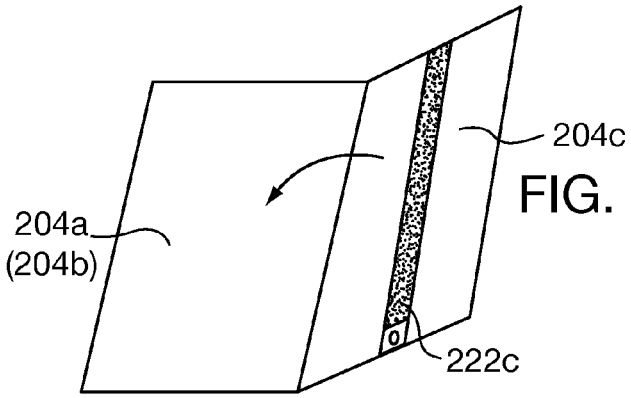

When the reinforcing straps 222*a-c* are secure, the display and storage system 2 is ready for folding. In one exemplary method, the section 204*a* is folded over the central display section 204*b*, as shown in FIG. 13E. The display section 204*c* is then folded over display section 204*a*, which was previously folded onto the display section 204*b*, as seen in FIG. 13F. This folding step results in a composite that has the approximate width of a single display section (e.g., 204*b*).

Figure 13G:
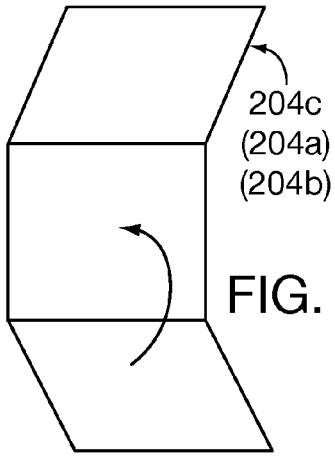
Figure 13H:
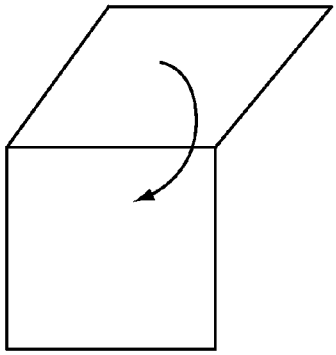

In FIG. 13G, the lower third of the folded display system 204*c* (already folded over sections 204*a* and 204*b*) may subsequently be lapped over the central third of the folded display system 204*c*. The upper third of the folded display system 204*c* may then be folded downwardly over the lower third and the central third, as shown in FIG. 13H, to create a compact package.

Figure 13I:
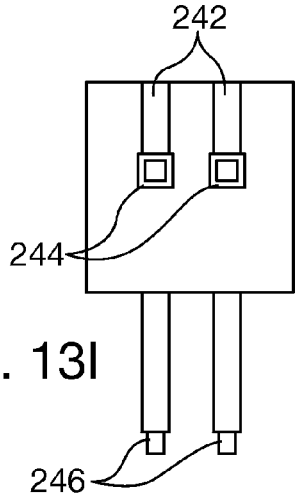
Figure 13J:
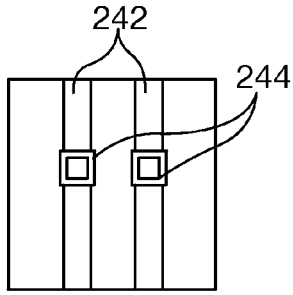

At this point, it may be desirable to secure the display and storage system in its folded and compact arrangement. To this end, a pair of closure straps 242 may be attached to the back of the central section (204*b*) of the display area 204. The straps 242 may include a latch mechanism 246 on distal ends thereof and a receptacle 244 on the proximal end thereof, which is configured to receive the latch mechanism, as seen in FIG. 13I. FIG. 13J shows the latch mechanism 244 in a closed position with the straps 242 wrapped completely around the folded display and storage system (2).

Alternately, other means may be used for securing the system in the folded and compact arrangement, including, but not limited to, pieces of material that may be tied together, a belt-and-buckle assembly, straps having hook-and-loop closures, straps having magnetic closures, straps having snaps, and the like.

FIG. 14 illustrates a smaller version of the display and storage system, shown in a covered configuration resembling that shown in FIG. 13C. In this display and storage system 300, the system 300 is designed for folding a single time along a central axis. Two protective covers 302, 304 cover the display area. The protective covers 302, 304 may each cover at least half of the display area (not shown in this Figure) and may be secured to the underlying base material by snaps or by one of the other connection methods described previously. A single reinforcing strap 322 may be secured over the center of the display system 300 and attached using a snap 325, as shown, or multiple reinforcing straps 322 may be used.

When closed, the display system 300 may be secured using a zipper closure 354, as seen in FIG. 15. Other closure mechanisms may be substituted as described above, to satisfy user preferences or requirements.

In yet another variation (not shown), the display and storage system may be configured to include only one or two module types. For instance, the display and storage system may be arranged to house only watches or a combination of watches and bracelets.

The removability of the individual modules 10, 20, 30, etc. and the use of identically sized connecting elements (e.g., snap closures) permits the user to customize the display and storage system (2) for his or her own particular needs. Moreover, the use of similar types of closures provides the user with a high degree of ease and comfort in removing both the modules and the individual jewelry or accessory pieces.

The preceding discussion merely illustrates the principles of the present jewelry and accessory display and storage systems. It will thus be appreciated that those skilled in the art may be able to devise various arrangements, which, although not explicitly described or shown herein, embody the principles of the inventions and are included within their spirit and scope. Furthermore, all examples and conditional language recited herein are principally and expressly intended to be for educational purposes and to aid the reader in understanding the principles of the inventions and the concepts contributed by the inventor to furthering the art and are to be construed as being without limitation to such specifically recited examples and conditions.

Moreover, all statements herein reciting principles, aspects, and embodiments of the invention, as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. Terms such as "upper", "top", and "lower" are intended only to aid in the reader's understanding of the drawings and are not to be construed as limiting the invention being described to any particular orientation or configuration.

This description of the exemplary embodiments is intended to be read in connection with the figures of the accompanying drawings, which are to be considered part of the entire description of the invention. The foregoing description provides a teaching of the subject matter of the appended claims, including the best mode known at the time of filing, but is in no way intended to preclude foreseeable variations contemplated by those of skill in the art.

What is claimed is:

1. A jewelry and accessory display and storage system comprising:

a foldable base material;

pairs of base connecting elements arranged on the base material at spaced intervals to create a display area, the pairs of base connecting elements being spaced to define at least two longitudinal sections of the base material, the base connecting elements being selected from the group consisting of snaps, magnets, hook-and-loop closures, and ties;

plural modules, each module configured for holding a particular type of jewelry, or accessory in one of the at least two longitudinal sections of the base material, at least one of the modules being provided with at least a pair of module connecting elements corresponding to and being removably engaged with at least one of the pairs of base connecting elements attached to the base material;

wherein one of the modules is selected from the group consisting of a necklace module, a bracelet module, and a watch module, each of the modules comprising at least two loops for securing a respective necklace, bracelet, or watch, each loop comprising a piece of flexible material having an attached end, a free end, and loop connecting elements for securing the free end to the attached end, and a further one of the modules is selected from the group consisting of a charm or pendant module, a ring module, a clip-on earring module, a stud earring module, a pierced earring module, a cufflink module, a decorative pin or medal module, a watch module, and a pocket module;

wherein one of the modules has spaced pairs of holes along a length of fabric thereof and a pivotable trough attached to the base material, a piece of the jewelry engaged with the holes in the length of fabric; and a portion of the piece of jewelry is positioned within the trough; and a plurality of stems extending downwardly on the module, a pair of leaves extending downwardly from each one of said plurality of stems, each of the leaves defining an aperture there through for receipt of a piece of the jewelry.

2. The jewelry and accessory display and storage system of claim 1 wherein the base material is selected from the group consisting of woven fabrics, jacquard woven fabrics, knit fabrics, non-woven fabrics, leather, artificial leather, vinyl, flexible composites, and coated fabrics.

3. The jewelry and accessory display and storage system of claim 2, wherein the base material comprises a composite having a cushion layer positioned between two opposing fabric layers and a cushion layer positioned between the two fabric layers.

4. The jewelry and accessory display and storage system of claim 3, wherein the opposing fabric layers are jacquard fabrics.

5. The jewelry and accessory display and storage system of claim 1, wherein the necklace module has at least one pair of spaced apart loops, each loop comprising a piece of flexible material having an attached end, a free end, and loop connecting elements for securing the free end to the attached end, such that a necklace positioned within the loops is secured by connection of the free ends of the loops to the attached ends of the loops.

6. The jewelry and accessory display and storage system of claim 5, wherein the attached ends of the loops are connected to the base material.

7. The jewelry and accessory display and storage system of claim 5, further comprising a separable piece of flexible material, the flexible material being provided with module connecting elements at corners thereof, wherein the attached ends of the loops are attached to the flexible material and wherein the flexible material is removably attached to the base material by securing the module connecting elements to corresponding base connecting elements.

8. The jewelry and accessory display and storage system of claim 1, wherein the bracelet module has at least one pair of spaced apart loops, each loop comprising a piece of flexible material having an attached end, a free end, and loop connecting elements for securing the free end to the attached end, such that a bracelet positioned within one of the loops is secured by the connection of the free ends of the loops to the attached ends of the loops.

9. The jewelry and accessory display and storage system of claim 8, wherein the attached ends of the loops are connected to the base material.

10. The jewelry and accessory display and storage system of claim 8, further comprising a separate piece of flexible material, the flexible material being provided with module connecting elements at corners of the flexible material, wherein ends of the loops are attached to the flexible material and wherein the flexible material is removably attached to the base material by securing the module connecting elements to corresponding base connecting elements.

11. The jewelry and accessory display and storage system of claim 1, wherein the charm or pendant module, has a plurality of hangers attached to a fabric panel and configured for holding a charm or pendant, and at least one charm or pendant hung from one of the hangers, and wherein the module connecting elements of the fabric panel are removably attached to the base connecting elements of the base material.

12. The jewelry and accessory display and storage system of claim 1, wherein the ring module has a plurality of loops connected to the fabric panel, each loop having an attached end, a free end, and connecting elements for securing the free end to the attached end to form a loop, and at least one ring, the ring being held within the fabric loop, wherein the module connecting elements of the fabric panel are removably attached to the base connecting elements of the base material.

13. The jewelry and accessory display and storage system of claim 1, wherein the clip-on earring module has a fabric panel with a pair of clip-on earrings attached thereto.

14. The jewelry and accessory display and storage system of claim 1, wherein the cufflink module has a fabric panel having a plurality of tabs extending downwardly from the fabric panel, each tab defining a pair of holes therethrough, the holes being reinforced by grommets, and a pair of cufflinks positioned through the holes of one of the tabs.

15. The jewelry and accessory display and storage system of claim 1, wherein the pin or medal module, has a plush fabric panel having module connecting elements attached to the back thereof at the corners, and further comprising a decorative pin or medal pinned through the fabric panel.

16. The jewelry and accessory display and storage system of claim 1, wherein the watch module has at least one pair of spaced apart loops, each loop comprising a piece of flexible material having an attached end, a free end, and loop connecting elements for securing the free end of the attached end, such that a watch positioned within the loops is secured by the connection of the free ends of the loops to the attached ends of the loops.

17. The jewelry and accessory display and storage system of claim 16, wherein the attached ends of the loops are connected to the base material.

18. The jewelry and accessory display and storage system of claim 16, further comprising a separable piece of flexible material provided with module connecting elements at the corners thereof, wherein the attached ends of the loops are attached to the flexible material.

19. The jewelry and accessory display and storage system of claim 1, wherein a pocket module has a pocket material sewn to define one or more pockets, each pocket being provided with a closure device.

20. The jewelry and accessory display and storage system of claim 19, wherein the pocket material is selected from the group consisting of a mesh fabric, a transparent material, and a translucent material.

21. The jewelry and accessory display and storage system of claim 20, wherein the pocket material is sewn to the base material.

22. The jewelry and accessory display and storage system of claim 20, wherein the pocket material is sewn to a separate fabric panel provided with module connecting elements at the corners thereof.

23. The jewelry and accessory display and storage system of claim 1, further comprising at least one protective covering for covering the display area.

24. The jewelry and accessory display and storage system of claim 1, further comprising at least one reinforcing strap originating at one side of a display area of the storage system, the reinforcing strap extending across the display area and terminating on a further side of the display area.

25. The jewelry and accessory display and storage system of claim 1, further comprising at least one closure device for securing the display and storage system in a folded configuration, the closure device being selected from the group consisting of straps with a latch and receptacle assembly, pieces of material that are tied together, a belt-and-buckle assembly, straps having hook-and-loop closures, straps having magnetic closures, and straps having snaps.

* * * * *